United States Patent [19]

Son

[11] Patent Number: 5,032,097

[45] Date of Patent: Jul. 16, 1991

[54] APPARATUS FOR ASSEMBLING AN ELECTRON EMISSIVE PART OF A CATHODE

[75] Inventor: Kyungcheon Son, Kyungki, Rep. of Korea

[73] Assignee: Samsung Electron Devices Co., Ltd., Kyungki, Rep. of Korea

[21] Appl. No.: 451,767

[22] Filed: Dec. 18, 1989

[30] Foreign Application Priority Data

Apr. 11, 1989 [KR] Rep. of Korea ..... 89-4772

[51] Int. Cl.[5] ..... H01J 9/06

[52] U.S. Cl. ..... 445/67; 29/511; 72/198; 445/50

[58] Field of Search ..... 72/189, 406, 387, 198; 29/505, 509, 511; 445/36, 50, 57

[56] References Cited

U.S. PATENT DOCUMENTS

| | | | |
|---|---|---|---|
| 2,736,948 | 3/1956 | Barnes | 72/198 X |
| 3,076,915 | 2/1963 | Gal et al. | 445/50 |
| 4,893,052 | 1/1990 | Tanabe et al. | 445/50 |

*Primary Examiner*—Kenneth J. Ramsey

[57] ABSTRACT

There is disclosed an apparatus for assembling the electron-emissive part of cathode comprising a porous base metal penetrated with an electron-emissive material and a thin metal plate for covering the base metal. The apparatus comprises a pair of cylindrical rolls for rotating in the direction opposite to each other with contacting to each other, and at least a pair of depressions each formed in one of the peripheries of the rolls for receiving respectively and complementarily the opposite portions of the electron-emissive part.

2 Claims, 3 Drawing Sheets

APPARATUS FOR ASSEMBLING AN ELECTRON EMISSIVE PART OF A CATHODE

BACKGROUND OF THE INVENTION

The present invention concerns an apparatus for assembling the electron-emissive part of a cathode comprising a porous base metal penetrated with an electron-emissive material and a thin metal plate for covering the base metal.

Conventionally, the cathode used for a Braun tube, camera tube, etc. comprises a porous base metal penetrated with an electron-emissive material, a sleeve for mounting said base metal on one end thereof, and hereafter received by said sleeve. Referring to FIG. 1, the reference numerals 1, 2, and 3 respectively indicate the porous base metal penetrated with an electron-emissive material, the sleeve, and the thin metal plate that covers the base metal 1 in the form of a cup-shaped separating wall. The wall is welded or soldered to the sleeve at contact position 4, and the porous base metal 1 is soldered to the thin metal plate at contact position 5. The heater is not shown in FIG. 1.

The sleeve 2 is conventionally made of heat-durable metal to endure the operating temperature of the cathode which is generally greater than 1000° C. The heater usually comprises a tungsten wire which is coated with alumina to secure insulation at a high temperature.

In operation, when the cathode is heated to a temperature above approximately 1000° C., the Ba compound contained in the porous base metal 1 is emitted to the tungsten wire, attacking the insulating alumina thereon, so that the insulation of the heater is deteriorated, thereby consuming the heater. The heat-durable thin metal plate 3 is to keep the Ba compound from reaching the heater.

Referring to FIG. 2, the conventional apparatus for assembling the metal plate 3 and the porous base metal 1 presses the base metal 1 on the thin metal plate 3 by means of part A. Then, the porous base metal 1 and the thin metal plate 3 are pushed into the opening of die C for the metal plate 3 to cover the base metal 1. Thereafter part B is moved so that the edge portions of the thin metal plate 3 may be attached to the edge portions of the upper end of the base metal 1. Thus, the base metal is firmly fixed to the metal plate. In this case, the metal plate portion covering the side of the base metal is creased so as to reduce the contacting surface between the sleeve 2 and itself. Hence, the thermal conductance from the heater to the base metal is reduced. Namely, since there exist a number of gaps between the sleeve 2 and the separating wall, the emission current density is lowered due to the lowering of thermal efficiency.

Furthermore, the conventional apparatus intermittently operates to produce the electron emissive part, and therefore, has a low production efficiency.

SUMMARY OF THE INVENTION

It is an object of the present invention to provide an apparatus for assembling the electron-emissive part whereby the gaps between the sleeve and the electron-emissive part are considerably reduced.

It is another object of the present to increase the efficiency of producing the electron-emissive part by means of rotating motion of rolls.

According to the present invention, an apparatus for assembling an electron-emissive part of a cathode comprising a porous base metal penetrated with an electron-emissive material and a thin metal plate for covering the base metal, comprises a pair of cylindrical rolls for rotating in directions opposite to each other while contacting each other, at least a pair of depressions each formed in one of the peripheries of the rolls for receiving respectively and complementarily opposite portions of the electron-emissive part, and a pair of cuts each formed from a specified position of the upper end of one of the depressions to the periphery thereof.

DETAILED DESCRIPTION OF THE INVENTION

The present invention will now be described more specifically with reference to the drawings attached, only by way of example.

Figure 1:
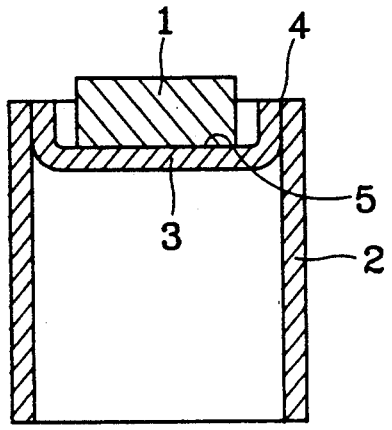
FIG. 1 is cross-sectional view of a conventional cathode.
Figure 2:
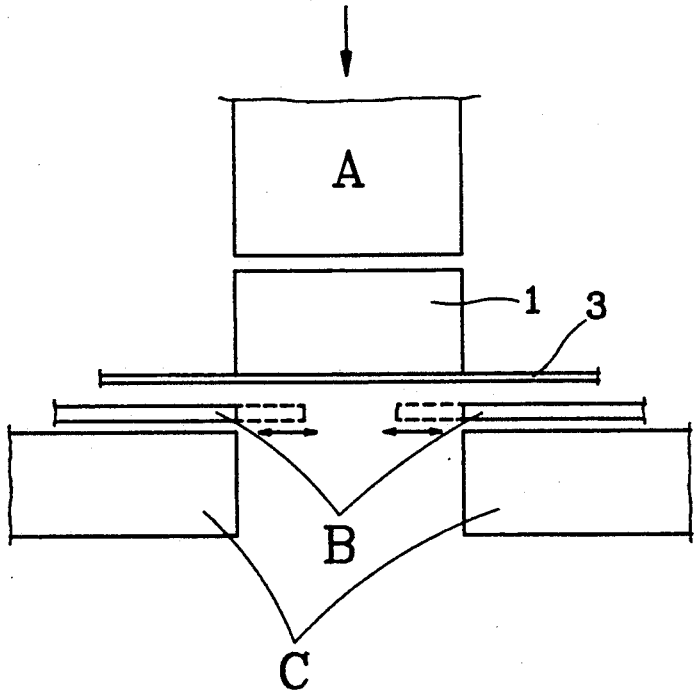
FIG. 2 schematizes a conventional apparatus for assembling an electron-emissive part.
Figure 3:
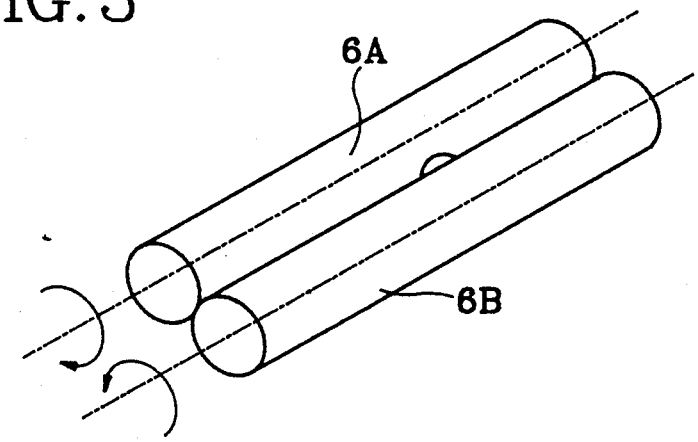
FIG. 3 is a perspective view for illustrating the inventive apparatus for assembling an electron-emissive part.

Referring to FIG. 3, two rolls 6A and 6B rotate in opposite directions and contact each other. A cross-sectional view of the rolls 6A and 6B contacting each other is shown in FIG. 4. Each of the rolls 6A and 6B has a depression in its periphery. The two depressions on the rolls receive respectively and complementarily opposite portions of the electron-emissive part. In order to readily insert a porous base metal 1 together with a thin metal plate 3 in the depressions, a pair of cuts are respectively formed from specified positions of the upper ends of the depressions to the peripheries thereof at an angle $\theta$. The distance 'g' between the specified position and the inner end of the depression represents the length by which the thin metal plate 3 covers the edge portions of the upper end of the base metal 1.

Figure 4A:
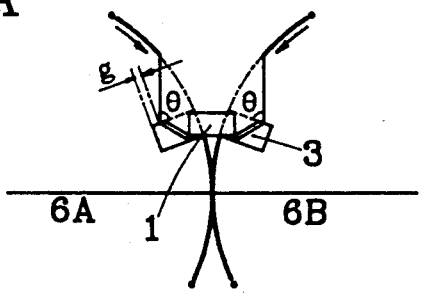
FIGS. 4A, 4B and 4C illustrate the steps of covering a porous base metal with a metal plate by using the inventive apparatus.
Figure 4B:
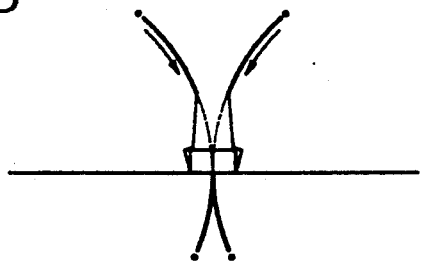
Figure 4C:
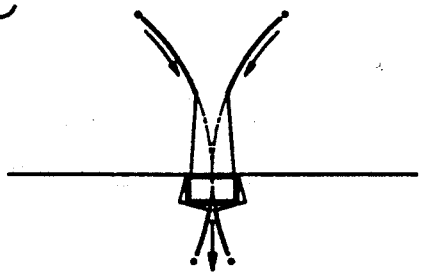

In operation, the thin metal plate 3 together with the base metal 1 is inserted in the depressions of the rolls 6A and 6B which are positioned as shown in FIG. 4A. Then, as the rolls rotate in opposite directions, the thin metal plate 3 covers the side of the base metal 1 in the position as shown in FIG. 4B, and the edges of the metal plate 3 are attached to the edges of the upper end of the base metal 1 in the position as shown in FIG. 4C. Finally, the electron-emissive part is discharged from the depressions. The number of depressions formed in the peripheries of the rolls may be properly selected as desired.

Figure 5:
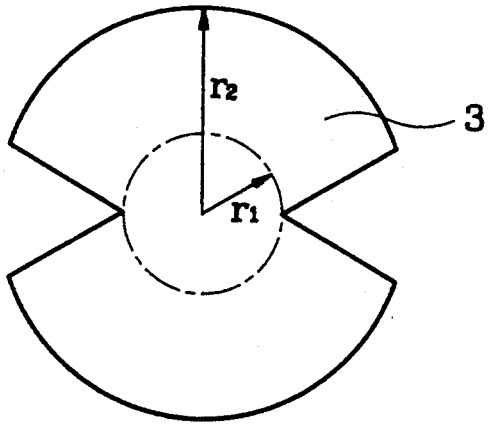
FIG. 5 is a plane view of a thin metal plate used in the inventive apparatus.

Referring to FIG. 5, the thin metal plate 3 has a circular shape suited to the cylindrical porous base metal 1. The radius rl of the inner circle of the base metal 1 equals the radius of the base metal 1. The inner circular portion is depressed compared to the peripheral portion of the metal plate 3. From the periphery of the inner circular portion to the periphery of the outer portion of the metal plate are cut out two or three sectors of suitable dimension. It is preferable that the length of the periphery of the inner circular portion equals the sum of the lengths of the peripheral sectors remaining after cutting out. When inserting the metal plate together with base metal in the depressions, the base metal is centered in the inner circular portion of the metal plate. Thus, when the metal plate 3 covers the base metal 1, it is not creased, so that the gaps between the sleeve and the metal plate are considerably reduced, thereby increasing the thermal efficiency.

Consequently, the contacting surface between the sleeve and the separating wall is considerably increased so as to improve the thermal conduction form the heater to the base metal. Additionally, the electron-emissive parts are continuously assembled according to the present invention, so that the production efficiency is increased.

What is claimed is:

1. An apparatus for assembling an electron-emissive part of a cathode comprising a porous base metal penetrated with an electron-emissive material and a thin metal plate covering said base metal; and apparatus comprising a pair of cylindrical rolls rotatable in directions opposite to each other and contacting each other, at least one depression formed in each periphery of each roll for receiving respectively and complementarily opposite portions of said electron-emissive part, and a cut formed from a specified position of an upper end of each depression to the periphery thereof.

2. An apparatus as claimed in claim 1, wherein the distance between said specified position and an inner end of said depression represents the length by which said thin metal plate covers an edge portion of an upper end of said base metal.

* * * * *